US006745956B1

(12) United States Patent
Bantle et al.

(10) Patent No.: US 6,745,956 B1
(45) Date of Patent: Jun. 8, 2004

(54) FUEL INJECTION VALVE FOR INTERNAL COMBUSTION ENGINES

(75) Inventors: Dietmar Bantle, Stuttgart (DE); Reiner Kaess, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 213 days.

(21) Appl. No.: 09/830,921

(22) PCT Filed: Sep. 18, 2000

(86) PCT No.: PCT/DE00/02816

§ 371 (c)(1),
(2), (4) Date: Jul. 27, 2001

(87) PCT Pub. No.: WO01/18386

PCT Pub. Date: Mar. 15, 2001

(30) Foreign Application Priority Data

Sep. 3, 1999 (DE) ..... 199 41 930

(51) Int. Cl.[7] ..... F02M 39/00

(52) U.S. Cl. ..... 239/533.3; 239/533.9; 239/533.11; 239/600; 123/470; 277/591

(58) Field of Search ..... 239/533.3, 533.8, 239/533.9, 533.11, 600; 277/591, 594, 595; 123/470

(56) References Cited

U.S. PATENT DOCUMENTS 4,246,877 A * 1/1981 Kennedy ..... 239/533.3
4,528,959 A * 7/1985 Hauser, Jr. ..... 277/591
5,044,340 A * 9/1991 Robnett ..... 123/470
5,070,845 A * 12/1991 Avdenko et al. ..... 239/533.3
5,129,658 A 7/1992 Berton et al.
5,247,918 A * 9/1993 Wakeman ..... 277/591
5,706,787 A * 1/1998 Fujikawa ..... 123/470

FOREIGN PATENT DOCUMENTS

| | | |
|---|---|---|
| DE | DE 196 05 956 A | 8/1997 |
| GB | GB 1 262 164 A | 2/1972 |
| GB | GB 2 138 887 A | 10/1984 |

* cited by examiner

*Primary Examiner*—Steven J. Ganey
(74) *Attorney, Agent, or Firm*—Ronald E. Greigg

(57) ABSTRACT

A fuel injection valve for internal combustion engines, having a valve body that tapers toward the combustion chamber, forming an annular heel, and merges with a valve shaft protruding as far as the inside of the combustion chamber. The fuel injection valve is disposed in a receiving bore, and the diameter of the receiving bore decreases toward the combustion chamber, forming a stop face. In the installed position, the annular heel is pressed against the stop face with the interposition of a sealing disk, and on the side toward the valve retaining body, the sealing disk has an annular rib encompassing it or interrupted at at least one point, and this annular rib surrounds the annular heel and engages an undercut, formed on the outside jacket face of the annular heel, and is thereby joined in captive fashion to the valve body.

20 Claims, 3 Drawing Sheets

Fig. 4
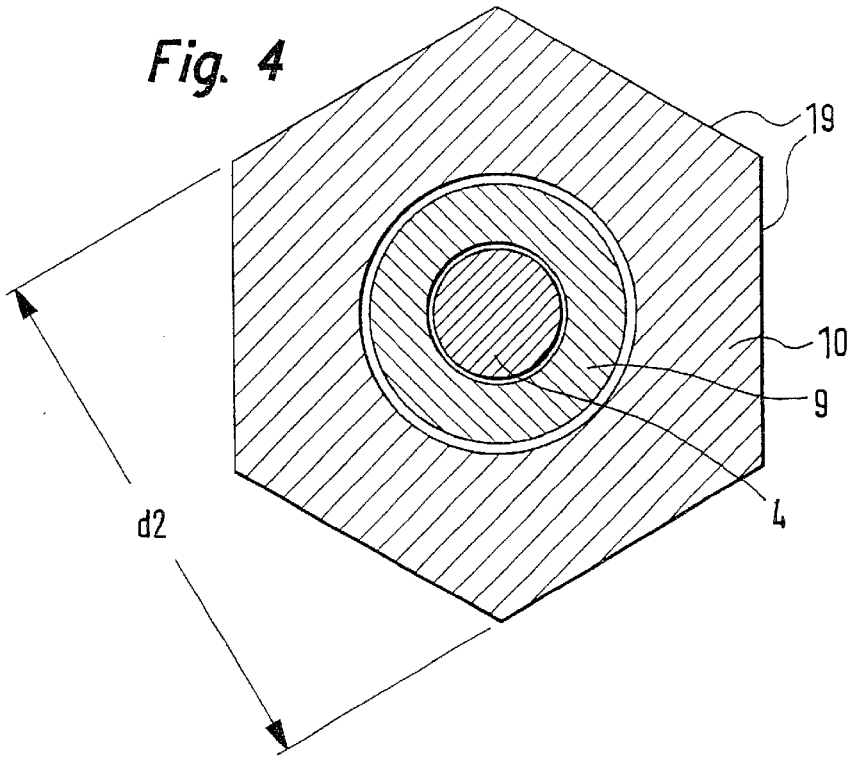
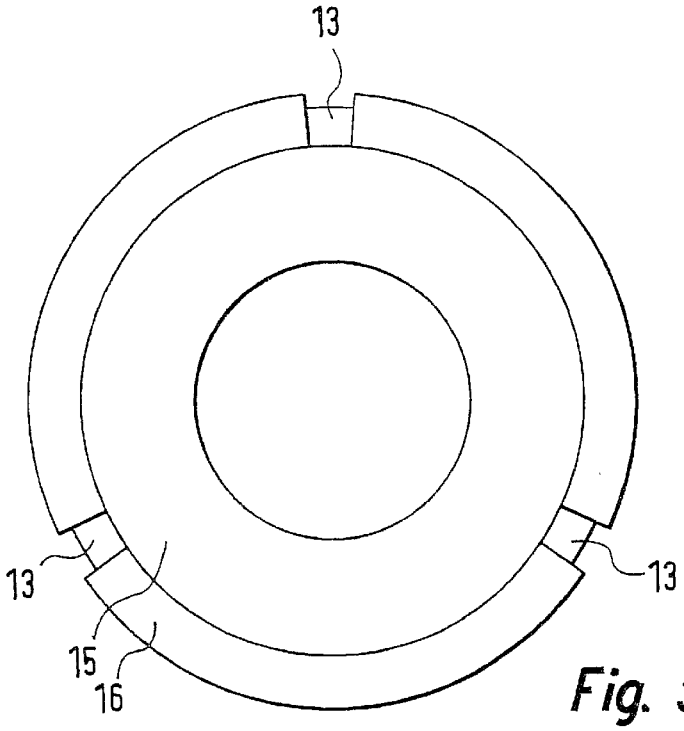
Fig. 5

FUEL INJECTION VALVE FOR INTERNAL COMBUSTION ENGINES

CROSS-REFERENCE TO RELATED APPLICATIONS

This application is a 35 USC 371 application of PCT/DE 00/02816 filed on Aug. 18, 2000.

BACKGROUND OF THE INVENTION

1. Field of the Invention

The invention is directed to an improved fuel injection valve for internal combustion engines.

2. Description of the Prior Art

One fuel injection valve of the type with which this invention is concerned is, known from German Published, Nonexamined Patent Application DE 196 05 956, and has an extensively rotationally symmetrical valve base body, which tapers toward the combustion chamber, forming an annular shoulder and thus merges with a valve body shaft that protrudes as far as the inside of the combustion chamber. The valve base body is braced axially against a valve retaining body by means of a lock nut that engages the annular shoulder. The fuel injection valve is disposed in a receiving bore formed in the housing of an internal combustion engine, and the inside diameter of the receiving bore decreases toward the combustion chamber, forming a stop face. In the installed state of the fuel injection valve, the lock nut comes to rest on the stop face of the receiving bore. By a suitable tightening device, the fuel injection valve is pressed into the receiving bore toward the combustion chamber and is thus pressed with the lock nut against the stop face. The sealing off from the combustion chamber is assured by a sealing disk in the form of an annular disk, disposed between the stop face and the lock nut. A sealing disk of this kind, known from German Application DE 196 05 956, is thrust into the receiving bore over the valve body shaft before the fuel injection valve is installed, and is retained on the valve body shaft by radial bracing.

When the fuel injection valve is disassembled from the receiving bore and then reinstalled, the sealing disk has to be replaced to assure reliable sealing from the combustion chamber. In the fuel injection valves, the disadvantage then arises that the sealing disk can stay behind in the receiving bore when the fuel injection valve is dismantled. From there, the sealing disk can be removed only with major effort, possibly requiring special tools.

Since the fuel injection valve is usually manufactured as an outside vendor part, the known sealing disks also have the disadvantage that the sealing disk can loosen during shipping and be lost. Reinstalling the sealing disk when the internal combustion engine is equipped requires a further operation and entails additional costs.

Another difficulty arises in the known sealing disks because of the radial bracing of the sealing disk on the valve shaft. Inside the valve shaft, a valve member is guided in a bore, and both the valve member and the bore are manufactured extremely precisely and with only very close tolerances. Hence it cannot be precluded that some impairment of this guidance will occur from the radial forces exerted on the valve shaft. Imprecise guidance of the valve member can cause inexact injection performance and can finally lead to failure of the fuel injection valve.

ADVANTAGES AND SUMMARY OF THE INVENTION

The fuel injection valve of the invention for internal combustion engines[, as defined by the characteristics of the body of claim 1,] has the advantage over the prior art that the sealing disk is joined in captive fashion to the lock nut, and no forces are exerted on the valve body shaft.

According to our embodiment, the undercut of the outside wall of the annular heel is formed in a simple way by means of a conical design. Accordingly, in the non-installed state, the outside jacket face of the sealing disk is likewise embodied at least approximately conically, so that after the annular rib has been wedged into the undercut of the annular heel, the outside jacket face of the sealing disk is virtually cylindrical. The cone angle for both the annular heel and the sealing disk is from 4 to 10°, preferably approximately 5°.

After the fuel injection valve has been removed, a new sealing disk must be placed on the annular heel of the lock nut and wedged against it with a pulling tool. In an auto repair facility, however, such a tool may not necessarily be available. In a further advantageous feature, a further, encompassing lower annular rib is therefore formed on the side of the sealing disk toward the combustion chamber, and this annular rib is located substantially opposite the first annular rib, the one remote from the combustion chamber. When the fuel injection valve is braced against the stop face formed in the receiving bore, the lower annular rib is pressed toward the valve retaining body and as a result presses the first annular rib inward into the undercut, so that the sealing disk is solidly connected to the lock nut without requiring any additional tool. The next time the fuel injection valve is dismantled, the sealing disk, as in the case of assembly with the aid of a pulling tool, is removed along with the fuel injection valve from the receiving bore.

In a further advantageous feature, the sealing disk has a smaller diameter than the lock nut. This makes it possible with a screwing tool, such as a screwing nut to reach past the sealing disk and thus screw the lock nut against the valve retaining body. The installation of the sealing disk can be done either before or after the lock nut is screwed to the valve retaining body.

According to our embodiment, the sealing disk is made from a metal that is soft in comparison to the material of the valve body, so that durable deformation without major effort is possible even at room temperature. For this purpose, copper, a copper alloy, soft iron or an aluminum alloy is suitable.

BRIEF DESCRIPTION OF THE DRAWINGS

Further advantages and features of the invention can be learned from the description contained below, taken with the drawings, in which:

FIG. 4 shows a cross section through the lock nut taken along the line IV—IV of FIG. 1; and FIG. 5 is a plan view on a sealing disk with an interrupted annular rib.

DESCRIPTION OF THE PREFERRED EMBODIMENTS

Figure 1:
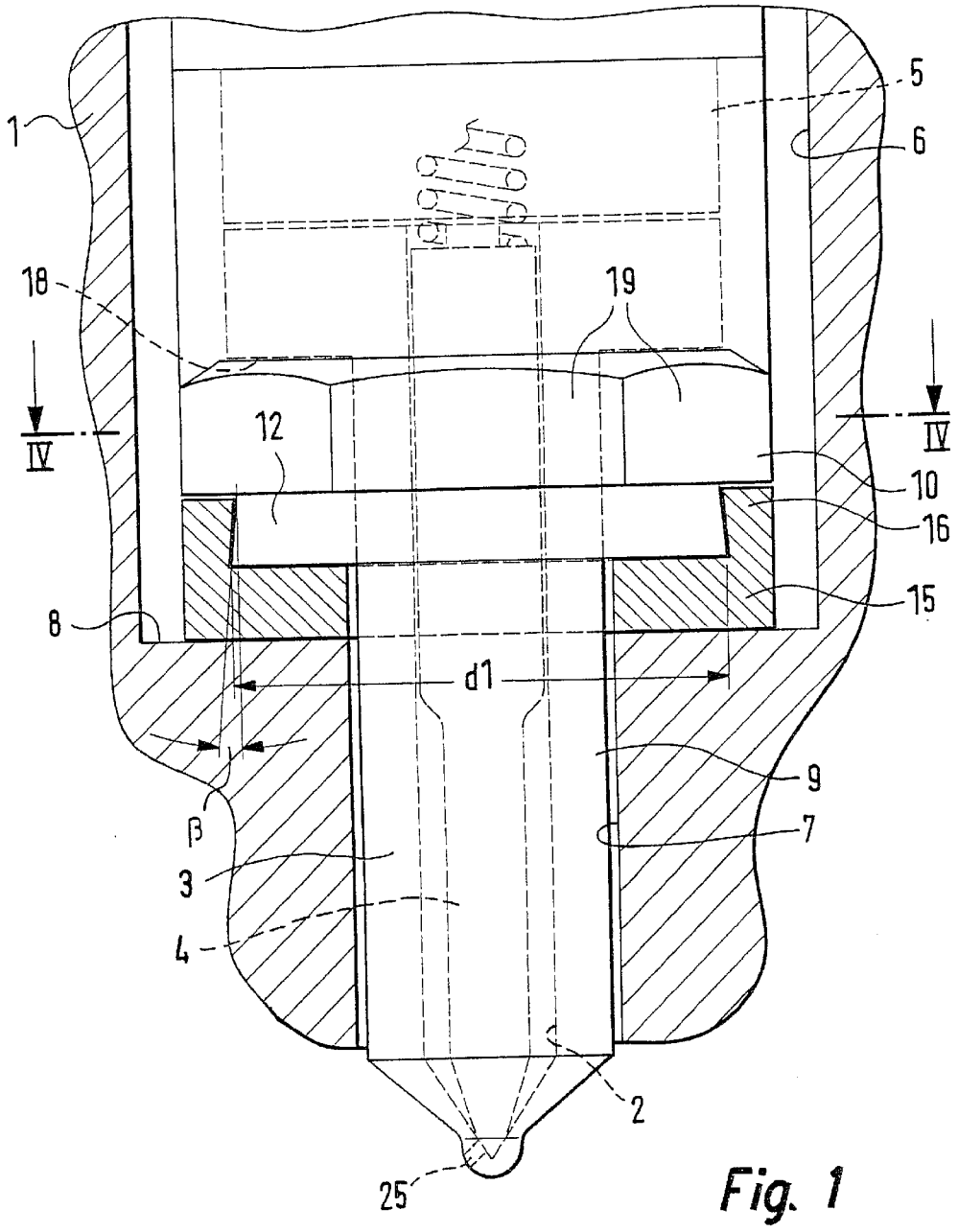
FIG. 1 shows a section through a fuel injection valve in the region of the sealing disk and shows the sealing disk in the installed position.

FIG. 1 shows a detail in longitudinal section of a fuel injection valve according to the invention for internal combustion engines. The fuel injection valve has a valve body, which is disposed in a receiving bore 6, 7 of a housing 1 of the engine. A valve base body 3 forms the part of the valve body toward the combustion chamber; it tapers toward the combustion chamber of the engine, forming an annular shoulder 18 and merges with a valve body shaft 9 that protrudes as far as the inside of the combustion chamber, and on whose end at least one injection opening 25 is disposed. A bore 2 is embodied in the valve base body 3, and in it a pistonlike valve member 4 is disposed that is axially movable counter to the closing force of a spring. As a result of the opening stroke motion, oriented away from the combustion chamber, of the valve member 4, the injection opening 25 is made to communicate with a high-pressure inlet conduit, not shown in the drawing, and fuel is injected into the combustion chamber. As an alternative to this, it can also be provided that the valve member 4 opens the at least one injection opening 25 by means of an outward-oriented opening stroke motion, that is, toward the combustion chamber. In this kind of fuel injection valve, known for instance from German Published, Nonexamined Patent Application DE 196 02 615 A1, the bore 2 is closed by a closing head disposed on the valve member 4; upon the opening stroke motion, this closing head emerges partway out of the bore 2 and in the process uncovers at least one injection opening.

The valve base body 3 is braced axially against a valve retaining body 5 by a lock nut 10 that surrounds the valve body shaft 9 and is supported on the annular shoulder 18. The lock nut 10 has a conventional hexagonal profile 19 on its jacket face. FIG. 4 shows a cross section through the lock nut 10 and the location of the hexagonal profile 19.

An annular heel 12 is formed on the end face of the lock nut 10 toward the combustion chamber; this annular heel has a smaller diameter d1 than the spacing d2 of the opposed screw faces 19. The jacket face of the annular heel 12 is at least approximately conically embodied, and the tip of the cone forming the conical face points away from the combustion chamber. This forms an undercut on the annular heel 12; the cone angle β of the annular heel 12 is approximately 4 to 10°, and preferably approximately 5°.

The receiving bore 6, 7 of the fuel injection valve in the housing 1 of the internal combustion engine tapers toward the combustion chamber. Because of the transition from the larger-diameter portion 6 of the receiving bore 6, 7 to the smaller-diameter portion 7, a stop face 8 is formed on the inside wall of the receiving bore 6, 7. In the installed position of the fuel injection valve, the face end of the lock nut 10 toward the combustion chamber comes to rest on the stop face 8, with the interposition of a sealing disk 15. The sealing disk 15 assures sealing off of the combustion chamber from the larger-diameter portion 6 of the receiving bore 6, 7.

Figure 2:
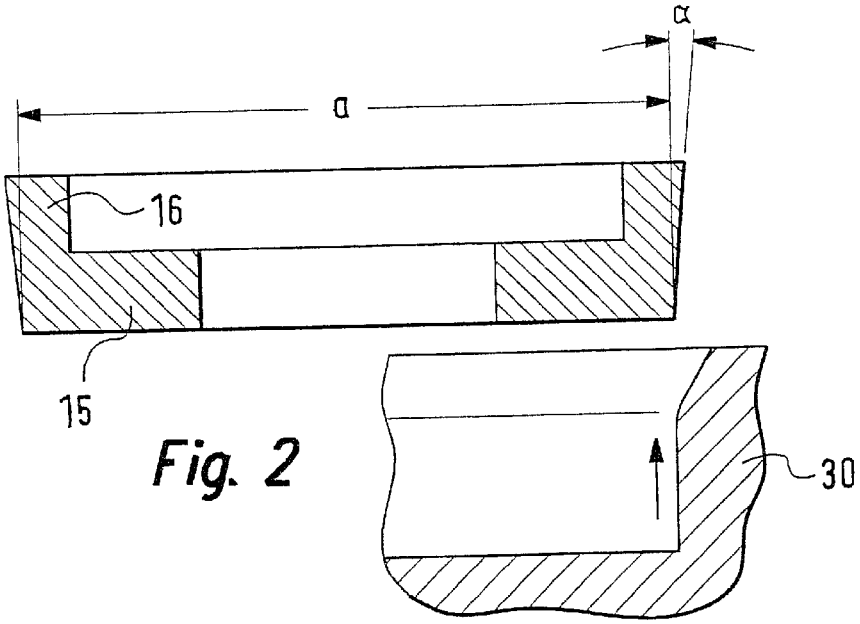
FIG. 2 shows a cross section through one version of the sealing disk before installation, along with one possible version of the pulling tool.

In FIG. 2, a longitudinal section through a sealing disk 15 of the invention is shown prior to installation. The sealing disk 15 is embodied as an annular disk, whose inside diameter is greater than the outside diameter of the valve body shaft 9. An annular rib 16 is formed on the end face of the sealing disk 15 remote from the combustion chamber, and the height of the annular rib 16 is approximately equal to the height of the annular heel 12 of the lock nut 10. The inside jacket face of the annular rib 16 is embodied at least approximately cylindrically, and the inside diameter of the annular rib 16 is so great that it can be slipped over the annular heel 12 formed on the lock nut 1 0. Before the sealing disk 15 is installed, at least the outside jacket face of its annular rib 16 has an at least approximately conical shape, and the outside diameter of the sealing disk 15 increases away from the combustion chamber. The cone angle a of the outside jacket face of the sealing disk 15 is between 4 and 10° and is preferably about 5° and is at least approximately equal to the cone angle β of the annular heel 12.

Figure 3:
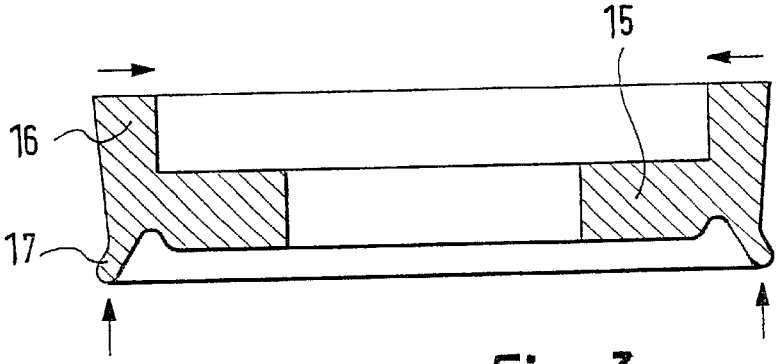
FIG. 3 shows a further version of the sealing disk.

In FIG. 3, an alternative version of the sealing disk 15 is shown. On the side remote from the valve retaining body 5, on the outer edge of the sealing disk 15, a further, encompassing, lower annular rib 17 is formed. With a smaller diameter than the lower annular rib 17, and concentrically with it on the same side of the sealing disk 15, an annular recess is formed, which makes the region formed by the two annular ribs 16, 17 more flexible than the middle piece in the shape of an annular disk. The lower annular rib 17, toward the combustion chamber, protrudes axially past the middle part of the sealing disk 15, so that when the sealing disk 15 is being installed, initially only the lower annular rib 17 comes to rest on the stop face 8.

Instead of an encompassing annular rib 16, it can also be provided that the annular rib is interrupted at one or more points. FIG. 5 shows the plan view on such a sealing disk 15 with three annular openings 13, which are distributed uniformly over the circumference. This makes it easier upon assembly to press the annular rib 16 inward into the undercut formed on the annular heel 12.

The assembly and mode of operation of the sealing disk 15 are as follows:

In the non-installed state, the inside jacket face of the annular rib 16 is embodied cylindrically, while the outside jacket faces on the sealing disk 15 have a conical shape. Once the sealing disk 15 with its annular rib 16 has been disposed over the annular heel 12, a pulling tool 30, which is shown schematically in FIG. 2, is pulled axially over the outside jacket face, thereby wedging the outside jacket face inward. As a result, the annular rib 16 engages the undercut on the jacket face of the annular heel 12 and thus assures a fixation of the sealing disk 15 on the lock nut 10 in the axial direction. As a result of this pulling operation, the outside jacket face of the sealing disk 15 becomes approximately cylindrical.

Alternatively, the deformation of the annular rib 16 into the undercut of the annular heel 12 can also be accomplished with a tool in which two dies in the form of half rings engage the annular rib 16 from the outside and wedge the outside jacket face of the annular rib 16 inward by means of a motion toward one another. The inside diameter of the dies in the form of half rings is equivalent to the diameter a of the annular disk 15.

The sealing disk 15 is made from a metal that is soft in comparison to the material of the lock nut 10, preferably from copper, a copper alloy, soft iron, or an aluminum alloy. As a result, even at room temperature, a permanent plastic deformation of the sealing disk 15 by means of the pulling or pressing operation is possible. If the fuel injection valve is dismantled and then re-installed, the sealing disk 15 has to be replaced. Because the depth of the undercut on the annular heel 12 is only slight, it is possible without major effort to loosen the sealing disk 15 from the lock nut 10, for instance with the aid of a special tool or a screwdriver.

In a version as shown in FIG. 3, the sealing disk 15 is placed over the annular heel upon assembly. Next, the fuel injection valve is introduced into the receiving bore 6, 7, and the lock nut 10 is braced against the stop face 8. As a result, the lower annular rib 17 of the sealing disk 15 is pressed toward the valve retaining body 5 and presses the annular rib 16 inward, into the undercut formed on the annular heel 12.

The direction of motion of the annular ribs 16, 17 is indicated in FIG. 3 by arrows. Once the fuel injection valve has been fully braced in the receiving bore 6, 7, the sealing disk 15 is securely joined to the lock nut.

The function of the sealing disk 15 as indicated above is assured even if the outside jacket face of the annular heel 12 does not have a conical shape but instead has an undercut formed differently. Since the sealing disk 15 is of a metal that is soft in comparison with the material of the lock nut 10, it can also positively engage undercuts embodied differently.

The foregoing relates to preferred exemplary embodiments of the invention, it being understood that other variants and embodiments thereof are possible within the spirit and scope of the invention, the latter being defined by the appended claims.

What is claimed is:

1. In a fuel injection valve for internal combustion engines, having a valve body which has a valve base body (3), a valve retaining body (5), and a lock nut (10), wherein the valve base body (3) tapers toward the combustion chamber and is braced by the lock nut (10), which fits over the valve base body (3), against the valve retaining body (5), and which fuel injection valve is disposed in a receiving bore (6, 7) of an internal combustion engine, wherein a stop face (8) is embodied on the inside wall of the receiving bore (6, 7) by a reduction in the diameter toward the combustion chamber, on which stop face an annular heel (12), embodied on an outside jacket face of the valve body by a cross-sectional reduction toward the combustion chamber, comes to rest with the interposition of a sealing disk (15), the improvement wherein the sealing disk (15), on an end face remote from the combustion chamber, has an annular rib (16) extending over at least a part of the circumference of the sealing disk (15), which annular rib in the installed state engages an undercut formed on an outside jacket face of the annular heel (12) disposed on the valve body.

2. The fuel injection valve of claim 1, wherein the annular heel (12) is embodied on the side of the lock nut (10) toward the combustion chamber.

3. A fuel injection valve for internal combustion engines of claim 2, wherein an outside diameter (a) of the sealing disk (15) is less than the spacing (d2) of opposed screw faces (19) of the lock nut (10).

4. A fuel injection valve for internal combustion engines of claim 2, wherein the sealing disk (15) is made of a soft metal, in comparison to the material of the valve body, and preferably of copper, a copper alloy, soft iron, or an aluminum alloy.

5. The fuel injection valve of claim 1, wherein the outside jacket face of the annular heel (12), to form the undercut, has an at least approximately conical shape, and an outside diameter of the annular heel (12) decreases away from the combustion chamber.

6. The fuel injection valve of claim 5, wherein the outside jacket face of the annular heel (12) has a cone angle ($\beta$) of from 4 to 10°, and preferably approximately 5°.

7. A fuel injection valve for internal combustion engines of claim 5, wherein an outside diameter (a) of the sealing disk (15) is less than the spacing (d2) of opposed screw faces (19) of the lock nut (10).

8. A fuel injection valve for internal combustion engines of claim 5, wherein the sealing disk (15) is made of a soft metal, in comparison to the material of the valve body, and preferably of copper, a copper alloy, soft iron, or an aluminum alloy.

9. The fuel injection valve of claim 1, wherein an inside jacket face of the annular rib (16), to form the undercut, has an at least approximately conical shape, and an inside diameter of the annular rib (16) decreases away from the combustion chamber.

10. A fuel injection valve for internal combustion engines of claim 9, wherein an outside diameter (a) of the sealing disk (15) is less than the spacing (d2) of opposed screw faces (19) of the lock nut (10).

11. The fuel injection valve of claim 1, wherein the annular rib (16) in the non-installed state of the sealing disk (15) has an at least approximately cylindrical inside jacket face.

12. The fuel injection valve of claim 1, wherein the sealing disk (15) in the non-installed state has an at least approximately conical outside jacket face, and an outside diameter of the sealing disk (15) increases away from the combustion chamber.

13. The fuel injection valve of claim 1, wherein an outside jacket face of the sealing disk (15) has a cone angle ($\alpha$) of from 4 to 10°, preferably approximately 5°.

14. The fuel injection valve of claim 1, wherein the annular rib (16), on its end remote from the combustion chamber, has a greater thickness than on its end toward the combustion chamber.

15. A fuel injection valve for internal combustion engines of claim 1, wherein an encompassing, lower annular rib (17) is embodied on the end face of the sealing disk (15) toward the combustion chamber, which annular rib, when the annular heel (12) is braced against the stop face (8), is pressed in the direction of the valve retaining body (5) and thereby presses the annular rib (16) into the undercut on the annular heel (12).

16. A fuel injection valve for internal combustion engines of claim 15, wherein an outside diameter (a) of the sealing disk (15) is less than the spacing (d2) of opposed screw faces (19) of the lock nut (10).

17. A fuel injection valve for internal combustion engines of claim 15, wherein the sealing disk (15) is made of a soft metal, in comparison to the material of the valve body, and preferably of copper, a copper alloy, soft iron, or an aluminum alloy.

18. A fuel injection valve for internal combustion engines of claim 1, wherein the annular rib (16) positively engages the undercut formed on the annular heel (12).

19. A fuel injection valve for internal combustion engines of claim 1, wherein an outside diameter (a) of the sealing disk (15) is less than the spacing (d2) of opposed screw faces (19) of the lock nut (10).

20. A fuel injection valve for internal combustion engines of claim 1, wherein the sealing disk (15) is made of a soft metal, in comparison to the material of the valve body, and preferably of copper, a copper alloy, soft iron, or an aluminum alloy.

* * * * *

UNITED STATES PATENT AND TRADEMARK OFFICE

CERTIFICATE OF CORRECTION

PATENT NO. : 6,745,956 B1 
DATED : June 8, 2004
INVENTOR(S) : Dietmar Bantle and Reiner Kaess It is certified that error appears in the above-identified patent and that said Letters Patent is hereby corrected as shown below:

Title page,
Item [22], PCT Filed, should read as follows:
-- Aug. 18, 2000 --

Signed and Sealed this

Twentieth Day of July, 2004

JON W. DUDAS
*Acting Director of the United States Patent and Trademark Office*